United States Patent [19]

Glueckert et al.

[11] 4,216,554

[45] Aug. 12, 1980

[54] AUTOMATIC FREEZE-PROOF DRAIN SYSTEM

[75] Inventors: Albert J. Glueckert, Skokie; Robert J. Honegger, Lake Zurich; Everett E. Nylund, Hoffman Estates; Philip A. Saigh, Morton Grove, all of Ill.

[73] Assignee: Gard, Inc., Niles, Ill.

[21] Appl. No.: 11,505

[22] Filed: Feb. 12, 1979

[51] Int. Cl.[3] ..... B61D 35/00; E03D 9/10; E03D 9/12

[52] U.S. Cl. ..... 4/323; 4/319; 4/406; 4/DIG. 3; 137/51; 137/62; 137/350

[58] Field of Search ..... 4/319-323, 4/300, 111.1, 406, DIG. 3; 137/51, 62, 347-350

[56] References Cited

U.S. PATENT DOCUMENTS

| | | |
|---|---|---|
| 864,118 | 8/1907 | Atkinson . |
| 1,028,808 | 6/1912 | Campbell . |
| 1,277,232 | 8/1918 | McGary et al. . |
| 1,749,356 | 3/1930 | Ross . |
| 1,786,878 | 12/1930 | Van Keuren . |
| 1,924,251 | 8/1933 | McGuire . |
| 2,514,040 | 7/1950 | Eksergian . |
| 3,642,015 | 2/1972 | Walters . |
| 3,812,872 | 5/1974 | Block et al. . |
| 3,908,204 | 9/1975 | Hopkins . |
| 3,986,489 | 10/1976 | Schlesinger . |
| 4,044,754 | 8/1977 | Cronin et al. . |

FOREIGN PATENT DOCUMENTS 1040806 10/1978 Canada ..... 4/323

OTHER PUBLICATIONS

Ogontz Thermal Drain Valve; Ogontz Controls Company; Jan. 1978.

*Primary Examiner*—Robert G. Nilson
*Attorney, Agent, or Firm*—Claron N. White

[57] ABSTRACT

A system to protect piping and containers from damage by freezing of contained aqueous liquid includes a temperature-actuated SPDT switch connected at its movable contact to a rechargable battery. The fixed contacts of the switch are connected to two input terminals of a DC motor of a motor-actuated valve having its valve opened or closed depending upon the operation of the switch. The movable contact normally engages the fixed contact that provides voltage to close the valve, if open, as the sensed temperature is above about 35° F., but moves to the other fixed contact when the temperature drops to 35° F. to open automatically the valve. A relay having a coil energized by AC power has a normally open contact coupling the motor and the fixed contact used to close the valve so that closing is inhibited, if the AC power is off, until power is on.

12 Claims, 8 Drawing Figures

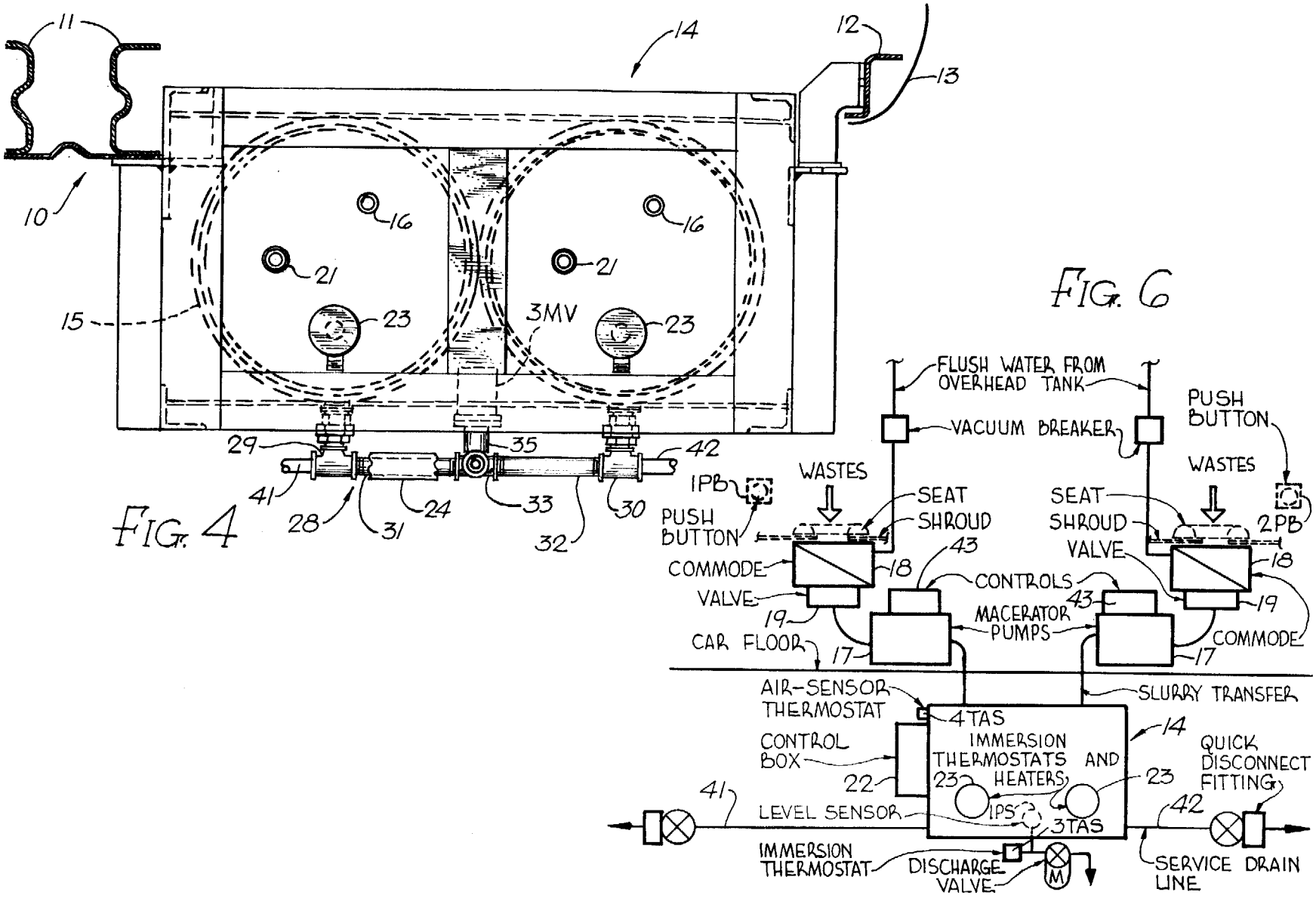
FIG. 6
FIG. 4
PUSH BUTTON
WASTES
2PB
18
19
COMMODE
17
SLURRY TRANSFER
QUICK DISCONNECT FITTING
SERVICE DRAIN LINE
42
14
23
FLUSH WATER FROM OVERHEAD TANK
VACUUM BREAKER
SEAT SHROUD VALVE
43
CONTROLS
MACERATOR PUMPS
IMMERSION THERMOSTATS AND HEATERS
3TAS
IPS
M
DISCHARGE VALVE
4TAS
AIR-SENSOR THERMOSTAT
CONTROL BOX
22
LEVEL SENSOR
IMMERSION THERMOSTAT
CAR FLOOR
IPB
PUSH BUTTON
COMMODE
VALVE
41
13
12
16
21
3MV
35
33
32
30
24
31
28
29
15
11
10

ROTARY SWITCH CLOSURE CYCLE

AUTOMATIC FREEZE-PROOF DRAIN SYSTEM

SUMMARY OF THE INVENTION

The system of the present invention protects piping and containers from damage caused by the freezing of contained liquids, illustratively aqueous liquids such as potable water and flushed sewage. The potable water is stored in supply tanks from which it is provided by piping, having valved drainage, to wash basins, water fountains, etc. and to commodes as flush water. The flushed sewage from commodes is stored in retention tanks having valved outlet piping.

One aspect of the system of the invention, that is a part of all other aspects of the system, is a combination of specific temperature-responsive means, that senses temperature of liquid in the drain piping, and specific power-responsive means that are operatively connected to each other.

The temperature-responsive means has a first terminal that in the use of this aspect of the system is connected to one terminal of a battery. In this use the battery has its other terminal connected to a first terminal of a power-operated drain valve means connected to the drain piping. The battery is connected to a battery charger connected to an AC power source. The temperature-responsive means has second and third terminals that, in the use of this aspect of the system, are connected to second and third terminals of the power-operated valve means.

The temperature-responsive means is constructed to provide a signal of different voltage level at its second terminal when the sensed temperature has lowered to a predetermined temperature, that is at least a few degrees above the freezing point of the liquid. The valve means, when its second terminal receives this signal of different voltage level, operates to open its valve. After the valve is opened, the continuation of the voltage level has no further effect on the valve. No further power is used.

The temperature-responsive means is also constructed to provide a signal of different voltage level at its third terminal, when the sensed temperature increases to a temperature above the predetermined temperature.

The power-responsive means is constructed so that a part of it is connected, in the use of this aspect of the system, to the AC power source and another part of it, that is connected to the temperature-responsive means, inhibits the transfer of the signal of different voltage level from the third terminal of the temperature-responsive means to the third terminal of the valved means if the AC power is off, but permits the transfer if the AC power is then on. If the AC power is then off, but later the AC power is turned on while the signal of different voltage level is still present at the third terminal of the temperature-responsive means, the transfer of the signal of the different voltage level will occur, whereby the valve of the valve means will close.

An illustative embodiment of this aspect of the system of the invention is a combination of a temperature-actuated SPDT switch, as the temperature-responsive means, and a relay having a normally open contact and a coil to be energized by AC power, as the power-responsive means.

In the use of this embodiment, the first terminal, i.e., the movable contact, of the switch is connected to a battery cathode terminal. The second terminal, i.e., the first fixed contact, of the switch is connected to the second terminal of the motor of motor-actuated valve means, as the power-operated drain valve means, while the first terminal of the motor is connected to the battery anode terminal. The second terminal of the motor is provided positive voltage when the movable contact engages the first fixed contact of the switch. When this occurs, the valve of the motor actuated valve means, if closed, is opened by the operation of the motor and the use of battery power ceases.

The normally open contact of the relay connects the third terminal, i.e., the second fixed contact, of the switch to the third terminal of the motor of the motor-actuated valve means. That normally open contact of the relay, if open when the switch provides positive voltage at its third terminal, inhibits the transfer of the positive voltage to the third terminal of the motor of the valve means to operate the motor to close the valve. This is the condition if the AC power is off. Thus no battery power is used to close the valve while the AC power is off. If the AC power is on, when the sensed temperature is above the predetermined temperature, whereby the switch provides positive voltage at its third terminal, the normally open contact of the relay is closed by the energizing of the coil of the relay. As a result the positive voltage transfer is not inhibited. The resultant positive voltage applied to the third terminal of the motor operates the valve, if open, to close it and then the motor ceases to use the battery power. During this operation of the motor, the battery charger is charging the battery.

The SPDT switch has its movable contact engaging the second fixed contact only while the liquid temperature in the piping being sensed exceeds the predetermined temperature. This is the normal position of the movable contact that engages the first fixed contact only when temperature sensed drops to the predetermined temperature or below.

A second aspect of the system of the invention is applicable to sewage discharge from a vehicle when the vehicle is moving at a predetermined speed. It is not applicable for the discharge of potable water when the vehicle is moving at the predetermined speed, because the potable water should not be dumped merely when the minimum speed condition is met. The second aspect of the system is the combination of the first aspect in combination with power-actuated speed switch means having a normally open switch in series with a coil of a second relay, to be energized by the AC power, if on, if the speed switch is closed, with the second relay having a normally open contact and a normally closed contact. The normally closed speed switch and the coil of the second relay have their series circuit connected in the use of the second aspect of the system to the AC power source.

The normally closed contact of the second relay is coupled between the third terminals of the temperature-responsive means and the power-operated valve means to inhibit the closing of the valve of the latter, if that normally closed contact is open because the speed switch is closed due to the speed of the vehicle exceeding a predetermined speed. The speed switch means further includes speed switch control means, in use, connected to the AC power source and a magnetic pickup to sense passing teeth of a gear mounted on an axle of the vehicle. The speed switch control means is adjusted to close and thereby to energize the coil of the second relay to open the normally closed contact of that relay, whenever the vehicle speed exceeds a predetemined speed.

The normally open contact of the second relay directly connects the battery athode terminal and the second terminal of the power-operated valve means and thus that contact is in a circuit parallel to that containing the second terminal of the temperature-responsive means. That normally open contact of the second relay closes when the second relay has its coil energized while the speed switch is closed. In that event, the valve of the power-operated valve means is opened by battery power even though the sensed temperature exceeds the predetermined temperature and whether the AC power source is off or on. However, the valve will not close until three conditions are met. One condition is the temperature sensed by the temperature-responsive means must exceed the predetermined temperature to provide the signal of different voltage level at its third terminal. The second condition is that the AC power is on, so that power-responsive means does not inhibit the transfer of the signal of different voltage level at the third terminal of the temperature-responsive means to the third terminal of the power-operated valve means. The third condition is that the speed switch is open, due to speed of the vehicle being less than the predetermined speed, so that the second relay's coil is not being energized whereby the normally closed contact of that relay is closed and thus does not inhibit the transfer of the signal of different voltage level from the third terminal of the temperature-responsive means to the third terminal of the power-operated valve means.

Although the speed switch means operates as described above to open the valve, it does so only if the AC power is on, and to close the valve but only if the temperature sensed by the temperature-responsive means is high enough and there is no inhibit by the power-responsive means as the AC power is on, there is no power loss by the battery because it is being charged by the AC power source though the battery charger.

In the foregoing the relay having the coil in series with the speed switch means is referred to as a second relay. That is the case in the illustrative embodiment when the power-responsive means includes a relay having a normally open contact inhibiting the transfer of positive voltage from the SPDT switch, as the temperature-responsive means. In another embodiment mentioned latter the power-operated valve means is a latching solenoid, and the temperature-responsive means is a temperature transducer and semiconductor devices that function to inhibit to inhibit the closing of the valve while AC power is off. In that case the second relay is the only relay being described and thus can be designated as a first relay.

The second aspect of the system provides by its presence of the speed switch means etc. for a drainage of sewage along the right of way when the vehicle is a railroad passenger car. This may become impermissible.

Third and fourth aspects of the system of the invention include the combination of the first aspect or the second aspect, respectively, with the battery, the battery charger and the power-operated valve means with the battery and valve means actually connected to the temperature-responsive means etc., including the contacts of the second relay, if present with the speed switch means, as described earlier.

A fifth aspect of the system of the invention, is the combination with any of the earlier aspects of a sewage retention tank having a bottom outlet connected by drain piping to the power-operated valve means, with the tank being mounted on a railroad passenger car and communicating with a toilet system.

Instead of using the temperature-actuated switch and the relay having the normally open contact, as the temperature-responsive means and the power-responsive means, described above, the system alternately, for example, includes a number of semiconductor devices providing a control logic and mounted on a panel, e.g., a wire-wrap panel, connected by a cable to a latching solenoid valve, as the power-operated valve means, that has a first terminal connected to the battery cathode terminal. The other two terminals of the latching solenoid valve are connected to semiconductor devices on the panel that provide a low-level voltage signal to one or the other of these two other terminals of the latching solenoid valve to open or close, respectively, the valve of the solenoid valve. In this construction of the system of the invention a temperature transducer, such as LX 5600 temperature transducer of National Semiconductor Corp., is used as the temperature-responsive means.

The transducer, in a known circuit, provides at its output terminal a high-level voltage signal, when the transducer senses a predetermined temperature or higher, and provides a low-level voltage signal, when the transducer senses a temperature that is no higher than the predetermined temperature.

The power input, reset input, output and ground terminals are connected by a shielded cable to semiconductor devices and a common ground on the panel. The battery anode terminal is connected to the common ground.

The control logic of the assembly of semiconductor devices on the panel processes the signal, either of low-level voltage or high-level voltage, from the output of the transducer and provides a low-level voltage signal exclusively to one or the other of the two terminals, mentioned above, of the solenoid valve, to open or close, respectively, the valve. The AC power is connected to a semiconductor device on the panel that, when AC power is on, provides from the battery a high-level voltage signal and that, when the AC power is off, provides a low-level voltage signal. That low-level voltage signal is used by the control logic to inhibit a low-level signal to the third terminal of the solenoid valve for unlatching and thus opening the valve as a result of the control logic processing the ligh-level output from the transducer. The low-level voltage signal when the AC power is off is not used by the control logic to inhibit the processing of a low-level voltage signal from the transducer to provide a low-level voltage signal to the second terminal of the solenoid valve to open the valve.

The advantages of thus using the temperature transducer and the latching solenoid valve with the control logic makes it particularly useful for automatic drain of potable water from a number of pipings that may be connected to one or more water supply tanks. The drain occurs simulateously if the transducer in any one of the pipings senses a temperature that is no more than the predetermined temperature. Also a common control logic is connected to all transducers and all latching solenoid valves. The control logic is modified as mentioned below.

In a railroad passenger car, for example, there may be as many as eight pipings, supplied with water from a common overhead water supply tank. The pipings and thereby the tank should be drained to prevent damage due to freezing. In this case, each piping is supplied with a latching solenoid valve and each piping has an associated temperature transducer mounted to sense the water temperature in that piping.

The outputs of the transducers (eight, for example) are connected to the battery cathode and to the inputs of an 8-input NAND gate that provides a high-level voltage signal at its output whenever any one or more of the transducers has a low-level voltage output and provides a low-level voltage output at the gate when all transducers provide a high-level voltage signal. When the output of the gate is a high-level voltage signal the control logic in this case is such to process it to provide a low-level voltage signal to the second terminal of the solenoid valve to open the valve. This occurs whether AC power is on or off. When the output of the gate is a low-level voltage signal the control logic porcesses that signal, if not inhibited by AC power being off, to provide a low-level signal to the third terminal of the solenoid valve to close the valve.

This modification of the system can minimize battery drain by using a clock and counters to power periodically the transducers for a limited time and then reset them during each cycle.

The illustrated overall system uses one or more retention tanks to store flushed sewage received from commodes and shows a specific mode of transferring the sewage to the tanks. The system of the present invention is useful with other toilet sytems in which tanks store macerated-sterilized sewage or chemically treated flushed sewage or store recyclyed liquid in a retention tank to be reused as flushing liquid.

DESCRIPTION OF THE DRAWINGS

The drawings show a preferred embodiment of construction of the automatic freeze-proof drain system of the invention for its use with commodes in a railroad passenger car in which flushed sewage in retention tanks from the commodes is automatically discharged from the tanks.

FIG. 4 is an end view of the assembly shown in FIG. 2, showing the mounting of the housing to the center sill and one side sill of the car.

FIG. 5. is an electrical schematic drawing showing the use of AC power by various circuits and the use of DC power by various circuits, the latter constituting one construction of the basic part of the invention, that opens automatically the discharge valve to drain flushed sewage from the tanks, if the sewage temperature is at or below a predetermined temperature or the car speed is at least a specific speed regardless of the condition of the AC power, and that closes automatically the discharge valve when the temperature sensed by the temperature-actuated switch is above the predetermined temperature, the car speed is below the specified speed and the AC power is on.

FIG. 5A is a fragmentary schematic drawing of a modification of FIG. 5, showing simpler circuits using the DC power, without an opening automatically of the discharge valve when the car speed is above a specified speed and without requiring that the car speed be below the specified speed or the car be moving for the closing automatically of the discharge valve when the temperature-actuated switch senses a temperature above the predetermined temperature and AC power is on.

FIG. 6 is a schematic drawing of the illustrative embodiment of the invention in its use with commodes on a car.

DETAILED DESCRIPTION

Figure 1:
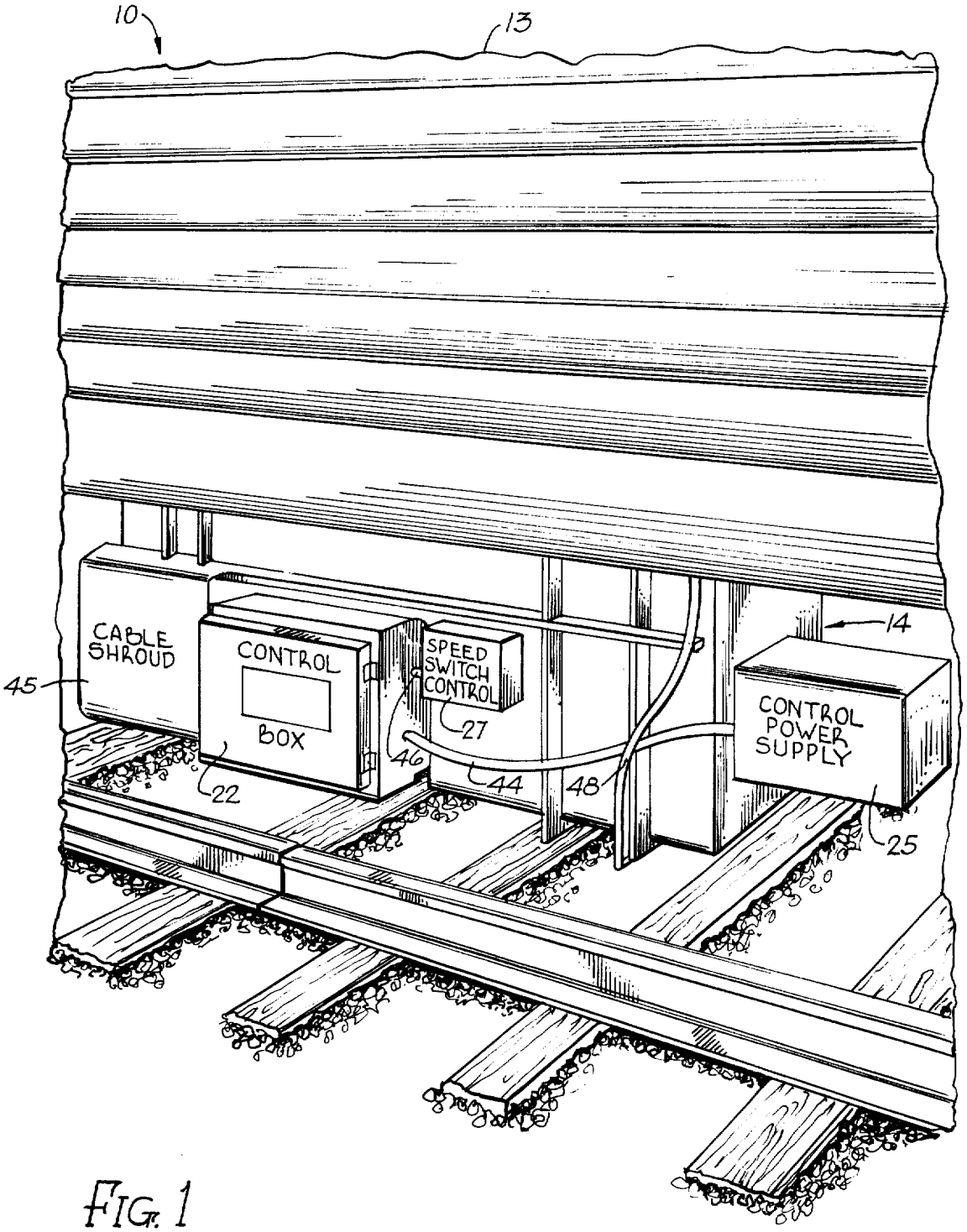
FIG. 1 is a fragmentary perspective view of the car, showing mounted below the car floor a housing for two flushed sewage retention tanks and various other boxes for some of the components used in the operation of the system of the invention.

Referring to FIGS. 1 and 4, a railroad passenger car generally indicated at 10 has a center sill 11 and a pair of side sills 12 (only one side sill being shown) below the floor of car 10. The siding 13 of car 10 extends below side sill 12. Between and mounted to one of side sills 12 and center sill 11 is an undercar insulated housing generally indicated at 14 (FIGS. 1, 2, 4 and 6). The housing 14 has a frame of angle irons to which are connected top and bottom cover plates, side plates and end plates. The specific manner of construction of housing 14 being no part of the invention and being adequately shown in the drawings requires no detailed description.

Figure 5:
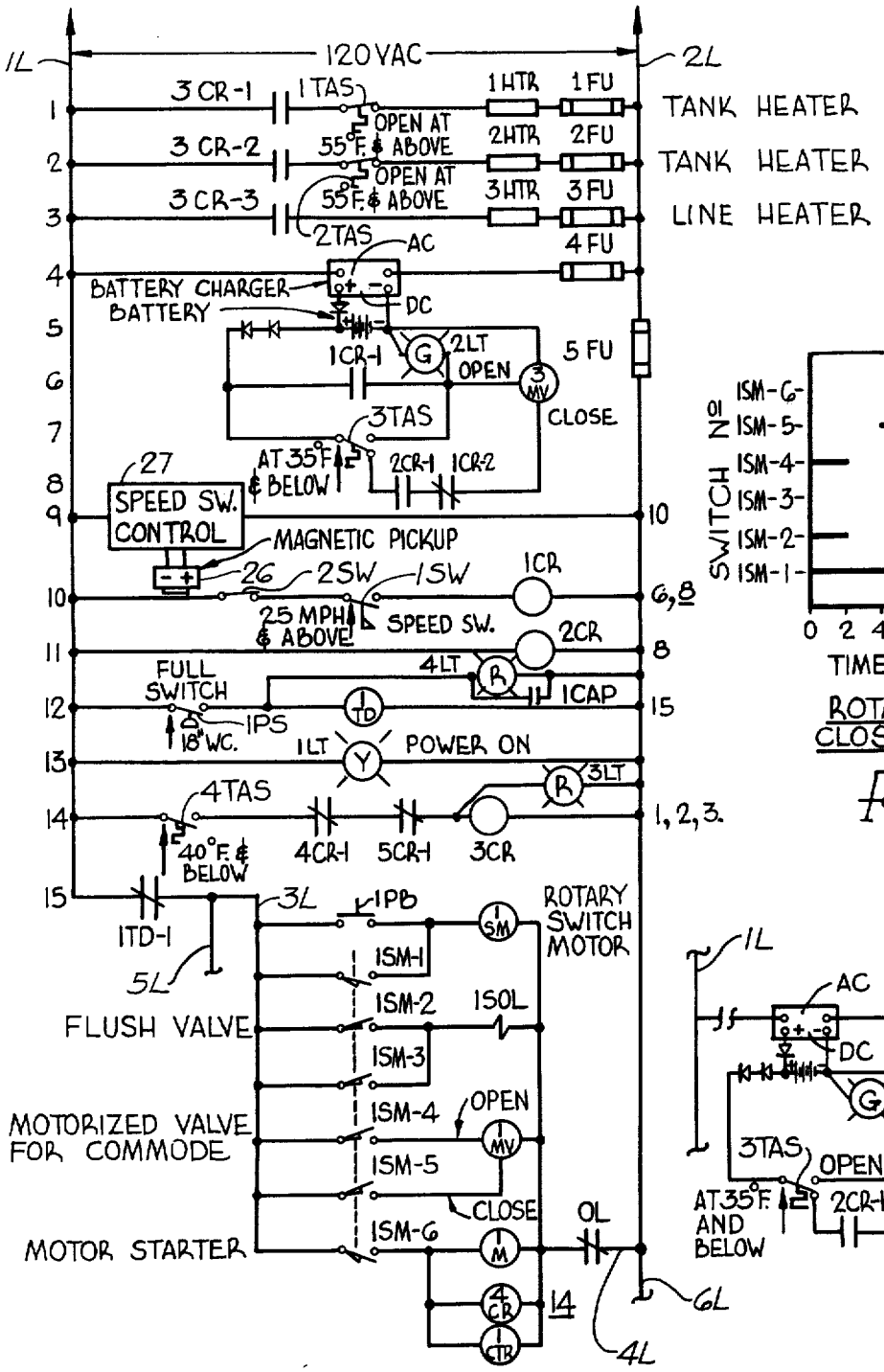

The housing 14 supports within it two horizontal glass-lined 80-gallon retention pressure tanks 15. A pair of short pipes 16 (FIGS. 2 and 4) extends through one end of housing 14. One end of pipe 16 is connected to one end of one tank above its center line. The other pipe 16 is similarly connected to the other tank 15. The pipes 16 are connected, as seen in FIG. 6, by piping (not numbered) to two macerator-transfer pumps 17 that receive sewage (flushed human waste) from commodes 18 when their motor-actuated valves 19 at the bottom of the bowls of the commodes are opened. The comodes 18 have have seats (not numbered). The commodes 18 have associated adjacent pushbutton switches 1PB and 2PB. The commodes 18 are provided with a shroud that encloses part of the commode, including its valve 19. Each commode 18 is connected by piping and a timed solenoid-operated valve, along with a conventional vacuum breaker, to a fresh water supply in an overhead tank. Each solenoid-operated valve has a solenoid. They are solenoids 1SOL and 2SOL. Only 1SOL is shown in FIG. 5, but the other is described later. Similarly each of pumps 17 includes a motor (not shown) and a coil (1M or 2M only one being shown in FIG. 5) of a starter relay for the motor. Also each valve 19 has a motor (1MV or 2MV only one being shown in FIG. 5) that when electrically operated turns 90° the ball, having a 3-inch opening, of the associated valve 19 to open or close the valve dependent upon which input terminal of the motor is provided with power. The electrical controls (described later) for each commode-pump unit are within a housing.

Figure 2:
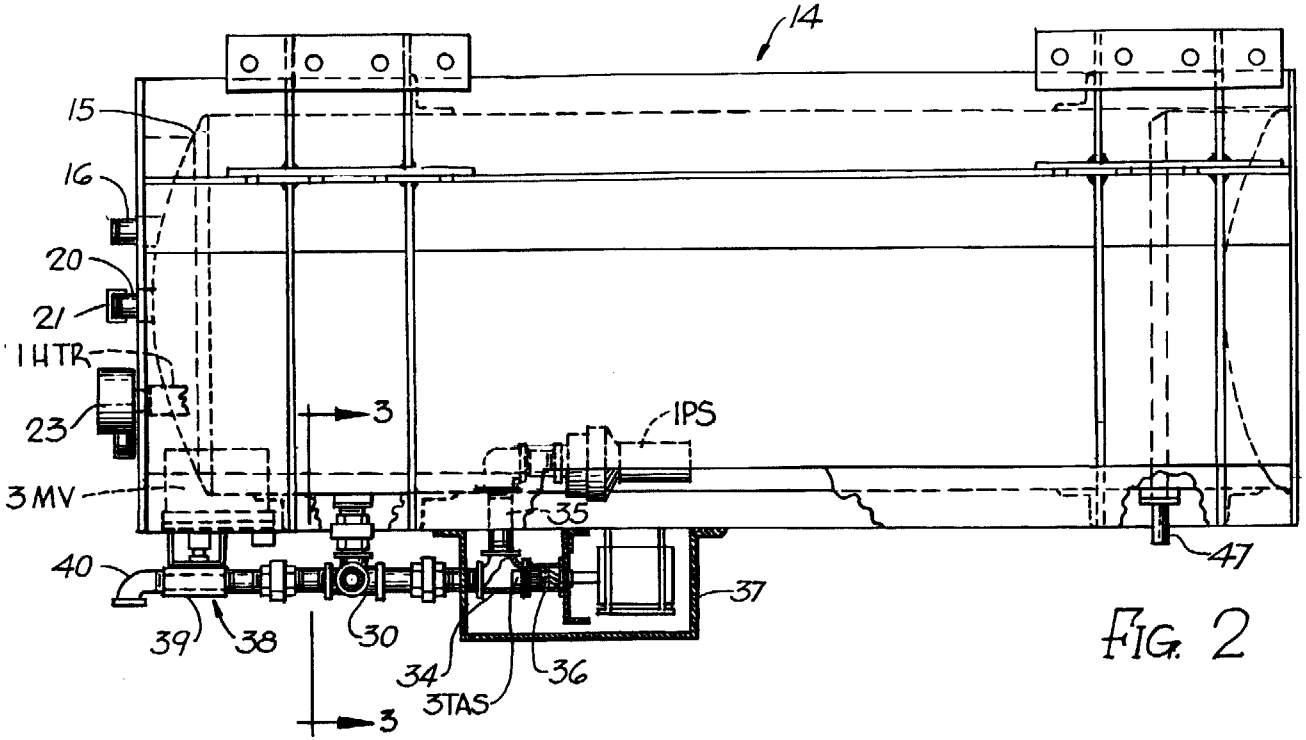
FIG. 2 is a side view, partly broken away, of the assembly of the housing and tanks, showing pipes and a heater-thermostat assembly mounted at one end of each tank and showing a discharge manifold connected to the bottom of both tanks, a motor-actuated discharge valve connected to the manifold, a temperature-actuated switch to sense sewage temperature in the manifold, and a pressure switch to sense sewage level in the tanks.
Figure 3:
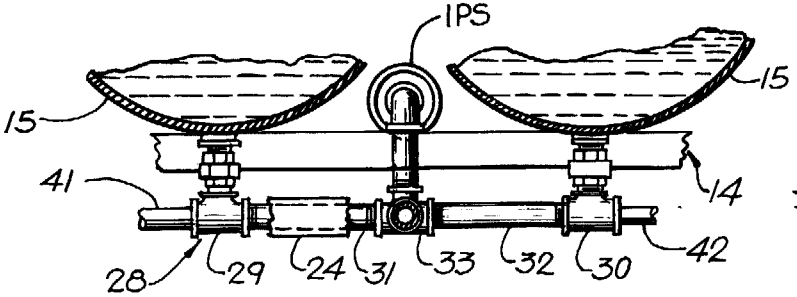
FIG. 3 is a fragmentary cross section taken along line 3—3 of FIG. 2.

A short pipe 20 is also connected to each tank 15 at the same end that pipe 16 is connected. The pipes 20 extend through that end of housing 14 (FIGS. 2 and 4). The outer end of each pipe 20 has a cap 21 mounted on it. The cap 21 is removed from each pipe 20 to connect pipe 20 to piping from a fresh flushing water supply (not shown). The pipes 20 are located at a lower level than pipes 16.

At a still lower level of each tank 15 is mounted a heater-thermostat assembly 23 with their heaters 1HTR and 2HTR and their temperature-actuated switches 1TAS and 2TAS extending into tanks 15 as shown in FIG. 2. The switches 1TAS and 2TAS open when the temperature in their associated tank 15 rises to 55° F.

As seen in FIG. 6, pipes 16 are connected by transfer lines to the outlets of macerator-transfer pumps 17 that are located in enclosures on the car floor adjacent or in the two toilet rooms. The transfer lines, for the portion that extends below the floor, are electrically heated by heating tapes wrapped around them. The heating tapes are designated 3HTR in FIG. 5. The tapes are covered with thermal insulation 24, a portion of which is shown in FIG. 4 on a pipe of a discharge manifold described later. The heaters 1HTR, 2HTR and 3HTR are connected to a 120 VAC power source in control power supply box 25 (FIG. 1).

A magnetic pick-up head 26 (e.g., a magnetic sensor of Electro Corp.) is connected by a coaxial cable to a speed switch control 27 (e.g., Mini-Speed Control of Electro Corp.) that includes a normally open speed switch 1SW (FIG. 5) connected in series with a lockout switch 2SW (FIG. 5). The magnetic pick-up is calibrated to operate from the existing gear on an axle of a car and is mounted at a clearance of 0.02" from the gear teeth.

Each of tanks 15 has a bottom drain opening. These openings are connected to a pipe manifold generally indicated at 28 (FIG. 4) most of which is below housing 14. The portion below housing 14 includes T fittings 29 and 30, pipes 31 and 32 and a fitting 33.

Also connected to fitting 33 by a pipe and coupling assembly (not numbered) is a fitting 34. A pipe 35 connected to fitting 34 extends upwardly into housing 14 between tanks 15. Connected to pipe 35 in housing 14, by an elbow and pipe (not numbered), is a normally open pressure switch 1PS that senses pressure in manifold 28 and thus the level of sewage in tanks 15. The switch 1PS closes at 18 inches of water head to signal the control system to prevent the flushing of the commodes, the opening and then closing of the valves below the openings of the toilet bowls of the commodes, and the operation of macerator-transfer pumps 17, because tanks 15 are full.

A pipe 36 also connected to fitting 34 extends horizontally. A SPDT temperature-actuated switch 3TAS (FIGS. 2, 5 and 5A) is mounted in pipe 36 at its closed end. The switch 3TAS is connected by wires to a cable connector at the closed end of pipe 36. The part of the cable connector outside pipe 36 is connected by a cable (not numbered) to a box (not numbered) where the cable is connected by a cable (not shown) to control box 22. That box, pipe 36, the part of pipe 35 below housing 14, fitting 34 and part of the pipe and coupling assembly connecting fittings 30 and 34 are within an insulated shroud 37.

The switch 3TAS, that thus monitors the temperature in manifold 28, is a construction having its movable contact abutting one fixed contact when the temperature exceeds 35° F. and the movable contact moves to and remains in abutment the other fixed contact of the switch when the temperature lowers to and remains at 35° F. and returns when the temperature rises.

Also connected to fitting 33 and extending away from fitting 34 is a horizontal pipe and coupling assembly (not numbered) connected to the inlet of a motor-actuated discharge valve generally indicated at 38 (FIG. 2) and having its valve 39 below housing 14 and its motor 3MV above valve 39 and inside housing 14. The outlet of valve 39 is connected to a discharge elbow 40.

The fittings 29 and 30 are also connected to pipes 41 and 42 that extend to the opposite sides of car 10, where they are connected, as shown schematically in FIG. 6 by manually-operated valves to a quick-disconnect fitting (all not numbered) to permit drainage of tanks 15 from either side of car 15, e.g., to a nearby sewer when or after adding flushing liquid via pipes 20 to tanks 15.

The various pipes, fittings, couplings and valve 39 that are outside housing 14 and shroud 37 are heated by heating tape 3HTR and covered with insulation 24 as described above for the transfer lines from pumps 17.

An air thermostat having a temperature-actuated switch 4TAS is mounted outside housing 14. Switch 4TAS signals the controls to turn on heaters 1HTR through 3HTR for heating liquid in tanks 15 and all of the heat-traced pipes etc., whenever the outside temperature lowers to 40° F. The switches 1TAS and 2TAS prevent heating tanks 15 and their contents above 55° F. as described earlier.

A cable 44 provides 120 VAC power from power supply box 25 to control box 22. A shroud 45 covers cables from box 22. A cable 46 provides a connection between box 22 and speed switch control 27 (also shown in FIG. 1). The cable 46 provides power to control 27 and its output signal to box 22.

Figure 7:
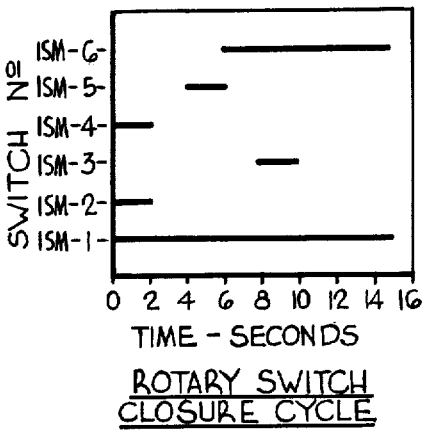
FIG. 7 is a graph showing the cycle of closure of switches of a rotary switch motor used to provide AC power to operate the timed solenoid valve for flushing water to the commode, the valve at the bottom opening of the commode, and the macerator-transfer pump that transfers the flushed sewage to the associated retantion tank, as well as to energize a coil of a relay to turn off the tank heater while the transfer-macerator pump is operating.

Each of the separate controls for the operation of motors 1MV and 2MV of motor-actuated valves 19, the flush water solenoid-valves having solenoids 1SOL and 2SOL, the coils 1M and 2M of the starter relays to start and stop operation of the motors for pumps 17 are in boxes 43 shown in FIG. 6. These components for one commode 18, valve 19 and pump 17 assembly are shown in FIG. 5. Each control also has a rotary switch motor with six switches. The one rotary switch motor shown in FIG. 5 has a switch motor 1SM and switches 1SM-1 through 1SM-6 that are closed during one cycle of operation of motor 1SM. The pattern of closing and opening switches 1SM-1 through LSM-6 is shown in FIG. 7. The other rotary switch motor (not shown) has a switch motor 2SM and switches 2SM-1 through 2SM-6 with the same pattern of closing and opening these switches as shown in FIG. 7. The motors 1SM and 2SM are connected to pushbutton switches 1PB and 2PB, respectively, to initiate their one cycle of operation whenever switches 1PB and 2PB are momentarily closed.

The initial operation of motor 1SM for one cycle results in the closing of switch 1SM-1 that remains closed until almost the end of the cycle, That switch being in parallel with switch 1PB maintains power to motor 1SM. When switch 1SM-1 is closed, switches 1SM-2 and 1SM-4 are closed to energize solenoid 1SOL for providing a limited amount of water to commode 18 and to actuate motorized valve 19 to open it by energizing motor 1MV. Later switches 1SM-2 and 1SM-4 open. Subsequently switch 1SM-5 is closed to close valve 19 by providing power to the other input terminal of the motor 1MV. About the time that switch 1SM-5 is opened, switch 1SM-6 is closed to energize motor 1M. Still later switch 1SM-3 is closed for a short period of time to energize solenoid 1SOL again to provide a limited amount of flush water to the bowl of the now closed commode. Still later switch 1SM-6 opens to stop the operation of pump 17 that was initiated by the closing of that switch. At the same time switch 1SM-1 opens to stop power to motor 1M. Then the rotor of motor 1M coasts to a position where it closes none of the six switches. The same mode of operation is provided by the other rotary switch motor for its associated commode etc.

As seen in FIG. 2, a vent pipe 47 extends upwardly through the bottom of housing 14 into and up to the top portion of tank 15. This is the construction for two vent pipes, one for each tank. The vent pipes 47 are connected by hoses or pipes 49 (FIG. 1) that extend to the top of the car.

The insulated control box 22 contains a battery charger and a rechargeable battery (both unnumbered but named in FIG. 5) along with some of the components shown in circuits 1 through 8 and 10 through 15 of FIG. 5.

Referring to FIG. 5, lines 1L and 2L are provided with 120 VAC power by cable 44 from control power supply box 25. The lines 1L and 2L represent lines in control box 22 and from box 22 to heaters 1HTR through 3HTR, speed switch control 27 (via cable 46), switches 1TAS and 2TAS of heater-thermostat assemblies 23, switch 1PS, switch 3TAS and switch 4TAS. Cables (not shown) provide the AC power from box 22 to controls 43. In FIG. 5, one of these two cables contains lines 3L and 4L connected to lines 1L and 2L, respectively, while the other cable contains lines 5L and 6L connected to lines 1L and 2L, respectively.

The circuits 1 through 3 contain fuses 1FU, 2FU and 3FU, respectively as shown. Circuit 4 has a fuse 4FU connecting the battery charger to line 2L. A fuse 5FU is in line 2L to be in series with circuits 9 through 15 and the circuits for the controls 43.

The circuits 5 through 8 operate on DC power from the battery in circuit. The battery has its cathode connected to the positive output of the battery charger, while the anode of the battery is connected to the negative output terminal of the charger. The connection from the cathode to the positive output terminal of the charger is via a diode (not numbered). A pair of diodes (not numbered) in circuit 5 connect the cathode of the battery to circuits 6 and 7 and by circuit 7 to circuit 8. The anode of the battery is connected to the output terminal of the motor 3MV of motor-actuated discharge valve 38 that has its two input terminals connected to circuits 6 and 7 and to circuit 8, respectively, as shown, to complete the circuitry to motor 3MV.

The circuit 6 includes a normally open contact 1CR-1 of a relay having a coil 1CR (circuit 10) that is energized to close contact 1CR-1, whenever normally open speed switch 1SW is closed by car 10 moving at a speed of 25 mph or above. This action occurs if normally closed lockout switch 2SW, in series with switch 1SW and coil 1CR in circuit 10, is in its closed position. The contact 1CR-1 is in series with the "open" input terminal of motor 3MV of motor-actuated discharge valve 38 having valve 39. A light 2LT is connected to the anode of the battery and to the line connecting contact 1CR-1 and the "open" input terminal of motor 3MW.

When contact 1CR-1 closes motor 3MW operates to turn valve 39 90° and then the motor stops even though contact 1CR-1 remains closed. No further power from the battery is used, except to keep light 2LT on. Of course, under thses conditions the battery is not being discharged, because it is being charged by the battery charger so long as it continues to receive AC power. When the AC power goes off, coil 1CR is deenergized and thus contact 1CR-1 opens to turn off light 2LT so that there is no drain on the battery when the charger stops charging. The AC power continues so long as the car is moving or even when it is not moving, because the AC power is provided from the engine when it is operating.

In circuit 7 is the movable contact of temperature-actuated SPDT switch 3TAS that is connected to the cathode, like contact 1CR-1 of circuit 6, via the pair of diodes. The first fixed contact of switch 3TAS is connected to the "open" input terminal of motor 3MW. The second fixed contact of switch 3TAS is connected to circuit 8 where it is in series with a normally closed contact 1CR-2, of the relay having coil 1CR, and a normally open contact 2CR-1 of a relay having a coil 2CR (circuit 11) that is connected to lines 1L and 2L.

The circuit 8 is connected to the "close" input terminal of motor 3MV. The circuit 8 provides by contacts 1CR-2 and 2CR-1, if both are closed, an operation of motor 3MV had its movable contact engaging the second fixed contact of that switch.

The switch 3TAS has its movable contact engaging the second fixed contact of that switch so long as the temperature of the sewage being sensed is above 35° F. When that is the case, motor 3MV operates to close valve 39, if open. Because contact 2CR-1 is closed only when AC power is on and thus energizes coil 2CR (circuit 11) and because switch 1SW is closed only when the car speed is at least 25 mph to thereby open contact 1CR-2, the position of switch 3TAS when sewage temperature is above 35° F. does not result in the closing of valve 39, if open, unless power is on and the car is stopped or moving at less than 25 mph.

If valve 39 has been opened to discharge sewage, because car 10 is moving at a speed of at least 25 mph or the sewage temperature has fallen to 35° F., any further sewage added to tanks 15 will be dumped until the temperature rises, power is on and car 10 is stopped or moving at a speed below 25 mph.

The requirement for a slow car or a stopped car to permit closing of valve 39 is eliminated by opening the lockout switch 2SW. That prevents energizing of coil 1CR that would open contact 1CR-2. In that case, valve 39 would not be opened by contact 1CR-1 as it would not close when the car speed reaches at least 25 mph. However, valve 39 would be opened when the temperature sensed by switch 3TAS is 35° F. or below and valve 39 will be closed when the temperature exceeds 35° F., but the closing occurs only when power is on and thus closes contact 2CR-1. The opening occurs regard less of the AC power but the depletion of the battery is small.

The speed control 27 (circuit 9) closed switch 1SW to energize coil 1CR when the speed is at least 25 mph for the purose descibed above.

The pressure switch (circuit 12) is closed when tanks 15 are full, i.e., should not or can not receive any more sewage until emptied or automatically discharged. The switch is in series with coil 1TD of a time-delay relay having a normally closed contact 1TD-1 (circuit 15) that opens about 10 seconds after coil 1TD is energized. This prevents a false signal of sewage level if the sewage is sloshing about in tanks 15 due to car movement. The contact 1TD-1 is connected to line 1L and is connected to lines 3L and 5L that provide connection to the two separate controls 43 for the two commodes. The controls 43 are connected to line 2L by line 4L for one control 43 and by line 6L for the other control 43.

The circuitry is shown in FIG. 5 for only one of controls 43. It has rotary switch motor 1SM, mentioned above, and switches 1SM-1 through 1SM-6 connected by thermal overload contact OL. The operation of motor 1SM and the closing and opening of the six switches is described above. The switches 1SM-1 and 1SM-6 are normally open, spring return switches, The others are normally closed, held open, spring return switches. In parallel with coil 1M between switch 1SM-6 and overload contact are a coil 4CR, of a relay having a normally closed contact 4CR-1 (circuit 14), and a counter 1CTR to indicate the number of uses of the associated commode 18.

If pressure switch 1PS is not closed, because there is still available capacity for sewage in tanks 15, contact 1TD-1 is closed. Then the closing of switch 1PB initiates the one cycle of operation of motor 1SM described earlier.

The circuitry for the other control 43 is the same as described above but using lines 5L and 6L and using pushbutton switch 2PB. The coil in parallel with switch 2SM-6 is designated coil 5CR and it has a normally closed contact 5CR-1 that is in series with contact 4CR-1, air temperature-actuated switch 4TAS and a coil 3CR of a relay having normally open contacts 3CR-1, 3CR-2 and 3CR-3. The switch 4TAS etc. are in circuit 14.

When the outside air temperature is 40° F. and below, switch 4TAS is closed. Thus, when contacts 4CR-1 and 5CR-1 are closed, coil 3CR is energized and this closes contacts 3CR-1 through 3CR-3. This occurs if coils 4CR and 5CR are not energized. They are energized only during a part of the one cycle of operation of motors 1SM and 2SM, either preventing energizing of coil 3CR, initiated by closing switches 1PB and 2PB. Thus while either macerator-transfer pump 17 is operating, heaters 1HTR and 2HTR and 3HTR are off, because coil 3CR can not be energized to close contacts 3CR-1 through 3CR-3 (circuits 1 through 3).

Contact 3CR-1 is in series with normally closed switch 1TAS and heater 1HTR. Contact 3CR-2 is in series with normally closed switch 2TAS and heater 2HTR. Contact 3CR-3 is in series with heater 3HTR. So long as coil 3CR is energized, heaters 1HTR and 2HTR are on, provided switches 1TAS and 2TAS are closed. If the temperature sensed in one of the tanks 15 exceeds 55° F., the associated heater 1HTR or 2HTR turns off due to the opening of 1TAS or 2TAS, respectively.

In parallel with coil 3CR to line 2L is light 3LT that, when lit, indicates that at least heater 3HTR is on.

In parallel with coil 1TD to line 2L is a light 4LT that, when lit, indicates the tanks 15 are full. In parallel also is a capacitor 1CAP.

When pressure switch 1PS is closed due to a full condition in tanks 15, contact 1TD opens after a delay, as described above, and this disconnects line 1L from lines 3L and 5L so that commodes 18 can not be provided with flush water, neither valve 19 will operate, and neither pump will operate even though switches 1PB and 2PB are closed.

Figure 5A:
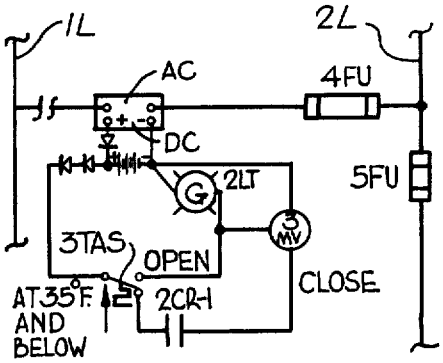

In FIG. 5A the circuitry is repeated except for certain deletions. Circuit 10 is not present. The speed switch 1SW is not used. There being no relay having coil 1CR, contact 1CR-1 and 1CR-2 are not present. Instead only switch 3TAS opens discharge valve 39 when the sewage temperature lowers to 35° F. Also, due to the absence of contact 1CR-2 in circuit 8, switch 3TAS, when it senses a sewage temperature above 35° F., will close valve 39, if AC power is on and thus energizing coil 2CR. This opening, even without AC power being on, and closing of valve 39 does not drain the battery. If valve 39 is opened while AC power is off, the short time to close valve is a short use of the battery and even if the sewage temperature then rises above 35° F. the battery can not be used to automatically close the valve 39 until AC power is restored. At that time the battery charger resumes the charging of the battery.

The circuit 13 merely has a light 1LT connected to lines 1L and 2L. When that light is on, it indicates that the AC power is on.

The foregoing description has been presented solely for the purpose of illustration and not by way of limitation of the invention because the latter is limited only by the claims that follow.

We claim:

1. A system to control the operation by a battery, that is connected by a battery to an AC power source, of power-operated drain valve means having first and second terminals that when exclusively signalled operate the valve means to open and close, respectively, its valve connected to the low end of piping connected to a higher tank containing liquid, said system comprising:

temperature-responsive means having a first terminal connectable to one terminal of the battery, and second and third terminals connectable exclusively to the first and second terminals, respectively, of the valve means; and power-responsive means connectable to the AC power source, connected to the battery charger, and connected to said temperature-responsive means, said temperature-responsive means and said power responsive means being constructed and operatively connected to each other in a manner so that, when said temperature-responsive means is connected to the battery and to the first and second terminals of the power-operated valve means and said power-responsive means is connected to the AC power source, a signal is provided to the first terminal of the valve means to open automatically its valve from said second terminal of said temperature-responsive means, only when the latter means senses a temperature at or below a predetermined temperature and does so regardless of the condition of the power-responsive means, and a signal is provided to the second terminal of the valve means to close automatically its valve from said third terminal only when both the latter senses a temperature above that predetermined temperature and the power source is on to provide power to said power-responsive means.

2. The system of claim 1 wherein:

said temperature-responsive means includes a temperature-actuated SPDT switch having a movable contact, as said first terminal, engaging a first fixed contact, as said second terminal, when the sensed temperature is at or below a predetermined temperature, and engaging a second fixed contact, as said third terminal, when the sensed temperature exceeds the predetermined temperature; and said power-responsive means includes a relay having a coil connectable to the AC power source and a normally open contact that is connected to said second fixed contact of said switch and connectable to the second terminal of the power-operated drain valve means.

3. The system of claim 1, to provide automatic drainage of sewage from a retention tank on a railroad car, said system further including:

speed switch means having:

a normally open speed switch;

speed switch control means connectable to the AC power source; and a magnetic pickup, that senses teeth of a rotating gear that is rotated by an axle of the car, said control means means being responsive to the rate of signals provided by said pickup to close said speed switch when the car speed exceeds a predetermined speed; and a relay having a coil, a normally open contact and a normally closed contact, in which:

said coil is connected in a circuit with said speed switch with the circuit being connectable to the AC power source;

said normally open contact of said relay is connected to said second terminal of said temperature-responsive means and connectable to the first terminal of said power-actuated valve means to provide it with the signal than opens the valve when the normally open contact closes, that occurs when the speed exceeds the predetermined speed, regardless of the sensed temperature; and said normally closed contact is connected to said third terminal of said temperature-responsive means and connectable to the second terminal of the power-actuated valve means to transfer the signal for the closing of the valve provided that or when the AC power is on and the sensed temperature is above the predetermined temperature, but inhibiting the transfer of that signal when the AC power is off.

4. The system of claim 3 wherein:

said temperature-responsive means includes a temperature-actuated SPDT switch having a movable contact, as said first terminal, engaging a first fixed contact, as said second terminal, when the sensed temperature is at or below a predetermined temperature, and engaging a second fixed contact, as said third terminal, when the sensed temperature exceeds the predetermined temperaure; and said power-responsive means includes a relay having a coil connectable to the AC power source and a normally open contact that is connected to said second fixed contact of said switch of said temperature-responsive means and in series with said normally closed contact that is connectable to said third terminal of said power-operated valve means, so that the closing of the valve is inhibited unless the AC power is on and the car speed does not exceed the predetermined speed.

5. The system of claim 1 and further including:

power-operated drain valve means having first and second terminals connected to said first and second terminals of said temperature-responsive means;

a battery charger connectable to the AC power source; and a battery connected to said battery charger and having one terminal connected to said first terminal of said temperature-resonsive means.

6. The system of claim 5 wherein:

said temperature-responsive means includes a temperature-actuated SDT switch having a movable contact, as said first terminal, engaging a first fixed contact, as said second terminal, when the sensed temperature is at or below a predetermined temperature, and engaging a second fixed contact, as said third terminal, when the sensed temperature exceeds the predetermined temperature; and said power-responsive means includes a relay having a coil connectable to the AC power source and a normally open contact that is connected to said second fixed contact of said switch and connected to said second terminal of said power-operated drain valve means.

7. The system of claim 6 wherein:

said power-operated valve means comprises a motor-actuated valve having a motor with first and second input terminals as said first and second terminals of said power-operated valve means;

said battery has its cathode terminal connected to said movable contact of said temperature-actuated switch and its anode connected to the output terminal of said motor; and said first and second fixed contacts of said SPDT switch are connected to said first and second input terminals but the connected between said second fixed contact and said second input terminal is provided by said normally open contact of said relay of said power-responsive means.

8. The system of claim 7, to provide automatic drainage of sewage from a retention tank on a railroad car, said system further including:

speed switch means having:

a normally open speed switch;

speed switch control means connectable to the AC power source; and a magnetic pickup, that senses teeth of a rotating gear that is rotated by an axle of the car, said control means being responsive to the rate of signals provided by said pickup to close said speed switch when the car speed exceeds a predetermined speed; and a second relay having a coil, a normally open contact and a normally closed contact, in which:

said coil of said second relay is connected in a circuit with said speed switch with the circuit being connectable to the AC power source;

said normally open contact of said second relay is connected to said first fixed contact of said SPDT switch in a series circuit with said first fixed contact and said first input terminal of said motor to operate the motor to open the valve when the speed of the car exceeds the predetermined speed; and said normally closed contact of said second relay is connected in series with said normally open contact of said relay of said power-responsive means to provide the connection between said second fixed contact of said SPDT switch and said second input terminal of said motor.

9. The system of claim 1 installed in a railroad car having mounted to the car an AC power source, connectable to an AC power supply on an engine, and a tank for aqueous liquid and drain piping for the tank, said system further including:

power-operated drain valve means connected to said drain piping and having first and second terminals connected to said first and second terminals of said temperature-responsive means;

a battery charger connected to said AC power source; and a battery connected to said battery charger and having one terminal connected to said first terminal of said temperature-responsive means.

10. The system of claim 9 wherein:

said temperature-responsive means includes a temperature-actuated SPDT switch having a movable contact, as said first terminal, engaging a first fixed contact, as said second terminal, when the sensed temperature in said piping is at or below a predetermined temperature, and engaging a second fixed contact, as said third terminal, when the sensed temperature exceeds the predetermined temperature; and said power-responsive means includes a relay having a coil connected to said AC power source and a normally open contact that is connected to said second fixed contact of said switch and connected to said second terminal of said power-operated drain valve means.

11. The system of claim 10 wherein said power-operated valve means comprises a motor-actuated valve having a motor with first and second input terminals as said first and second terminals of said power-operated valve means, said battery has its cathode terminal connected to said movable contact of said SPDT switch and its anode terminal connected to the output terminal of said motor.

12. The system of claim 11 wherein said tank mounted to the car is a sewage retention tank connected to a toilet system to receive flushed sewage from it, said retention tank being mounted below the car floor, said system further including:

speed switch means having:

a normally open speed switch;

speed switch control means connected to said AC power source; and a magnetic pickup, that senses teeth of a rotating gear that is rotated by an axle of said car, said control means being responsive to the rate of signals provided by said pickup to close said speed switch when the car speed exceeds a predetermined speed; and a second relay having a coil, anormally open contact and a normally closed contact, in which:

said coil of said relay is connected in a circuit with said said speed switch with the circuit being connected to said AC power source;

said normally open contact of said second relay is connected to said first fixed contact of said SPDT switch in a series circuit with said first fixed contact and said first input terminal of said motor to operate the motor to open the valve when the speed of said car exceeds the predetermined speed; and said normally closed contact of said second relay is connected in series with said normally open contact of said relay of said power-responsive means to provide the connection between said second fixed contact of said SPDT switch and said second input terminal of said motor.

* * * * *